US010252858B1

(12) United States Patent
Pearson et al.

(10) Patent No.: US 10,252,858 B1
(45) Date of Patent: Apr. 9, 2019

(54) CADDY FOR CLEANING SUPPLIES

(71) Applicants: Lindsay D. Pearson, St. Peters, MO (US); Daniel W. Ferguson, St. Clair, MO (US)

(72) Inventors: Lindsay D. Pearson, St. Peters, MO (US); Daniel W. Ferguson, St. Clair, MO (US)

( * ) Notice: Subject to any disclaimer, the term of this patent is extended or adjusted under 35 U.S.C. 154(b) by 0 days.

(21) Appl. No.: 16/011,303

(22) Filed: Jun. 18, 2018

Related U.S. Application Data

(60) Provisional application No. 62/521,628, filed on Jun. 19, 2017.

(51) Int. Cl.
*B65F 1/14* (2006.01)
*A47L 13/51* (2006.01)

(52) U.S. Cl.
CPC ..... *B65F 1/1431* (2013.01); *A47L 13/51* (2013.01)

(58) Field of Classification Search
CPC ..... B65F 1/1431; B65F 1/1426; A47L 13/51; B65D 1/24; B65D 1/243; B65D 21/0209; B65D 21/0233; B25H 3/06
USPC ..... 232/43.2, 43.3, 44, 43.1; 206/216, 373, 206/501, 561, 499; 220/908.3, 500, 555, 220/694, 86.1; 15/257.3, 257.01
See application file for complete search history.

(56) References Cited

U.S. PATENT DOCUMENTS

| | | | | |
|---|---|---|---|---|
| 3,751,845 | A | 8/1973 | van Leeuwen | |
| 5,086,917 | A * | 2/1992 | Dziersk | A47L 13/51 206/203 |
| D350,632 | S | 9/1994 | Cummins | |
| 5,881,891 | A * | 3/1999 | Murphy, Jr. | A47L 13/51 211/65 |
| 6,059,109 | A * | 5/2000 | Stein | B25H 3/06 206/373 |
| 6,460,697 | B1 * | 10/2002 | Stevens | B25H 3/06 206/225 |
| 7,290,651 | B2 | 11/2007 | Irwin et al. | |
| 8,636,169 | B2 * | 1/2014 | Sampaio | B65D 25/2891 200/555 |
| 8,684,192 | B1 | 8/2014 | Margolin | |
| 2004/0217238 | A1 | 11/2004 | Chochinov et al. | |

* cited by examiner

*Primary Examiner* — William L Miller
(74) *Attorney, Agent, or Firm* — Creati Venture Law, LLC; Dennis JM Donahue, III; Kevin C. Staed

(57) ABSTRACT

The present disclosure describes a caddy for cleaning supplies combining a storage tray, integrated chute and removable storage bin for holding dirty or contaminated items. The caddy generally has an upper section with a carrying handle for holding cleaning tools and a lower section used as a storage bin for dirty or contaminated items. In operation, the upper tray is removably fastened to the lower bin wherein the tray acts as a cover for the storage bin with the sidewalls of the storage tray positioned above the lower bin. Accordingly, the entire storage bin opening is covered by the tray when the upper section is fastened thereto. Additionally, a chute extends through the storage tray for depositing dirty or contaminated materials without unfastening the upper section from the lower section. Thus, unused or otherwise clean items are separated from dirty items while still being sufficiently held in a single caddy.

20 Claims, 4 Drawing Sheets

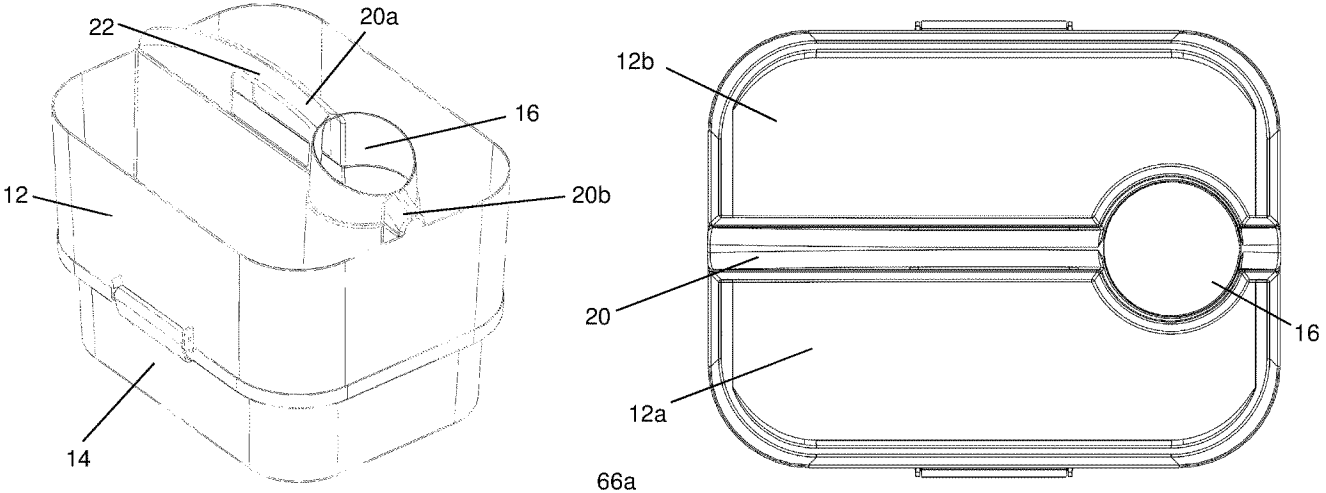
FIG. 3B
FIG. 3A
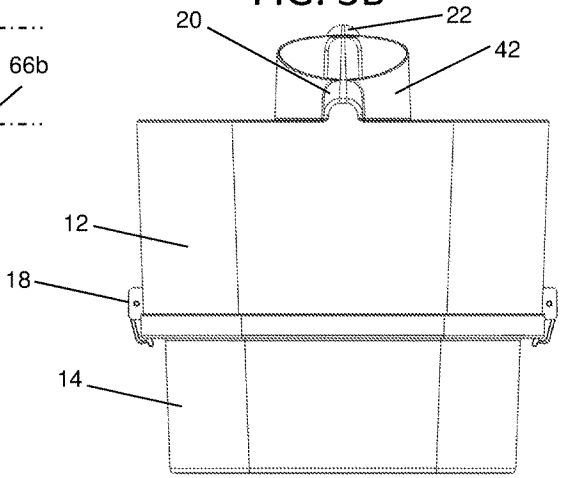
FIG. 3D
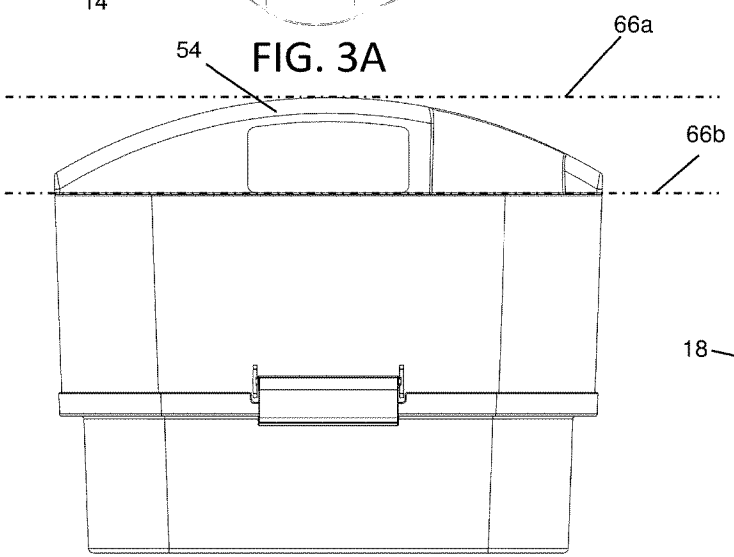
FIG. 3C

CADDY FOR CLEANING SUPPLIES

CROSS-REFERENCE TO RELATED APPLICATIONS

This application claims priority from U.S. Provisional Patent Application No. 62/521,628 filed Jun. 19, 2017 which is hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to a cleaning supply caddy and more particularly to a caddy for cleaning supplies having an integrated chute and storage bin for holding dirty or contaminated material.

Related Art

Caddies have been used for conveniently storing and carrying cleaning supplies. Most carrying caddies are made of a tray and include one or more compartments or attachments for holding cleaning supplies. Such caddies allow a person to conveniently bring a set of cleaning supplies into an area which may require various cleaning tools. For example, a person cleaning a bathroom may require a certain set of supplies for cleaning the sink, another set of supplies for cleaning the toilet, and third set of supplies for cleaning the bathtub and shower. Accordingly, caddies for cleaning supplies allow the person to easily tote multiple supplies at once.

During the cleaning operation, a person may carry the caddy into an area that is to be cleaned and begin the cleaning process with towels, rags, sponges, wipes, brushes, and similar items used when cleaning. Similarly, dirty or contaminated items may need to be removed from the area being cleaned and replaced with clean items, such as when used towels are replaced with clean towels in a bathroom or kitchen. Additionally, some cleaning supplies are disposable, such as paper towels, wipes, dusting cloths and similar items, and are intended to be thrown away after use. Accordingly, an inherent product of the cleaning process is transferring contaminated or dirty items out of an area as the area is cleaned. In accomplishing this task must individuals will have a separate trash container to hold contaminated items. To prevent cross contamination, it is a desire to those having skill in the art to provide a cleaning caddy which aids a person toting both clean and contaminated materials during the cleaning process while simultaneously reducing the likelihood of cross contamination.

Presently, most caddy devices only provide compartments and attachments for holding and storing cleaning supplies. When such caddies are used a person necessarily requires a separate container, such as a plastic trash bag, to place contaminated items in until the job is completed. Accordingly, most available caddies in the prior art require a person to not only bring the caddy into the area being cleaned but also another container for contaminated materials. Because multiple items are necessarily brought into the area, the person not only has to carry more than one item but also the chances of mishaps relating to the multiple items increases. For example, the addition of a separate trash receptacle provides a greater opportunity that one of the caddy or the contaminate receptacle will spill and create a greater mess. Similarly, bringing multiple totes into an area increases the likelihood that one of the totes will be left behind. Further, in the case of trash bags being used as the secondary container, the cost to the cleaner necessarily increases where trash bags are likely disposed of after use.

Other caddies in the prior art describe how the caddy can be attached to or supported by a trashcan or similar receptacle that can hold the contaminated items. For example, US Pat. App. Pub. No. 2004/0217238 by Chochinov describes a caddy for a container, such as a waste container, that is configured to be disposed on the rim of the container and receive and hold various cleaning tools. Similarly, U.S. Pat. No. 7,290,651 by Stephen describes a caddy for holding cleaning supplies having a pair of spaced a part compartments and attachments for attendant implements where the caddy can be supported on the rim of a collection bin, such as a trash receptacle. Accordingly, both the Chochinov reference and the Stephen reference necessarily require that a secondary container into which contaminated or dirty items can be deposited be provided in addition to the caddy.

Another problem with caddy systems described in the prior art, including the Chochinov reference and the Stephen reference, are the reliance on traditional trash receptacles that generally include plastic bags. Although plastic bags may adequately hold contaminated items and cleaning tools, the bags themselves are not intended for multiple uses and are necessarily replaced. Accordingly, there is a desire for a cleaning caddy with a separate bin that has sufficient accessibility and durability to allow a person to place dirty items into the bin while the caddy is being used to hold the cleaning supplies and the person is cleaning and to then clean and reuse the bin after dumping the dirty items that had been placed in the bin. Inherently, providing a reusable bin reduces cost to cleaning companies where they no longer need to purchase additional plastic bags.

It would also be advantageous if the bin is conveniently available to the person with the caddy and the cleaning supplies. Accordingly, there is a particular need for a portable caddy and a portable disposal bin that can be used together while cleaning. Where large trash bins and push carts are easily maneuvered through corridors, such as in a hotel, large bins and push carts are not readily maneuvered through smaller homes and offices. Accordingly, a portable caddy and a portable disposal bin are preferably able to be carried from place to place while cleaning.

Accordingly, there remains a desire for an improved portable caddy for carrying cleaning tools and a portable bin that is accessible, durable, and conveniently available while cleaning to hold contaminated and dirty items.

SUMMARY OF THE INVENTION

The present disclosure describes a caddy for carrying cleaning supplies having a tray section for holding fresh cleaning supplies and a bin section for holding contaminated items, and the tray section has a chute in operative communication with the bin section. In operation contaminated items pass through the chute into the bin where they are safely concealed away from clean items until they bin is detached and the contaminated items can be removed. The bin is removably connected to the bottom side of the tray by a fastener and can be detached to dump out contaminated items, hands free, without having to touch the contaminated items. Thus, the invention eliminates the need for disposable plastic bags to hold contaminated items during the cleaning operation and effectively segregates contaminated items from unused cleaning tools and the area being cleaned.

An aspect of the caddy is the combination of the storage tray for holding unused or otherwise clean supplies connected to the storage bin for holding contaminated supplies and the integrated chute connecting the two. Accordingly, the caddy incorporates clean and dirty storage areas into a single unit that can be brought into an area without necessarily bringing additional bags or container for contaminated items. As particularly described herein the chute has a pair of openings wherein contaminated materials are deposited into the top end and subsequently travel through the chute into the storage bin, which is operatively engaged with the bottom end of the chute. In operation, the bin can be filled with items as they are contaminated during the cleaning process which allows a user to carry or otherwise tote a single caddy which separately holds clean and contaminated items.

The preferred caddy embodiment is generally comprised of a tray arranged above the bin which are connected with one or more catch and latch fasteners, as explained herein. To deposit contaminated items into the bin, the tray has a chute portion with a top opening proximate to the top edge of the tray and a bottom opening along the bottom side. Accordingly, the bottom opening of the chute is open to the bin, and contaminated items pass there though. After cleaning, the bin can subsequently be detached from the tray, and the contaminated items can be washed for later or thrown away. Alternatively, the tray can be used separate from the bin as a traditional caddy.

Additionally, it is another aspect of the caddy to have a partition which separates the tray into multiple sections, and in the preferred embodiment the chute is integrated within the partition. A handle is preferably integrated with or attached to the tray through the partition wherein the entire caddy can be easily carried by an individual or the tray can be easily lifted free of the bin when the fasteners are disengaged. However, as described herein, the caddy can be toted as a single unit when the bin and tray are attached.

The invention is innovative where the upper tray covers the entire storage bin opening when the upper section is fastened to the lower bin. Such an arrangement allows contaminated materials to be deposited into the bin and held separately from the cleaning supplies in the tray. Additionally, in another aspect of the bin, an indent may be positioned underneath the bottom opening to promote dispersion of contaminated materials within the bin and thereby prevent the contaminated materials from piling up beneath and blocking the opening.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIGS. 3A and 3B are a perspective view and a top view, respectively, of the caddy for cleaning supplies in an alternative embodiment.

FIGS. 3C and 3D are side views of the caddy for cleaning supplies in an alternative embodiment.

DETAILED DESCRIPTION OF THE PREFERRED EMBODIMENTS

The following description of the preferred embodiment(s) is merely exemplary in nature and is in no way intended to limit the invention, its application, or uses.

The present disclosure is a caddy for holding and transporting cleaning supplies having an upper storage tray and a lower storage bin with a chute in the upper storage tray that is in operative communication with the lower storage bin. The lower bin is removably attached to the underside of the upper tray and can be used to hold contaminated materials proximate to but separated from the tray that preferably holds clean or otherwise unused cleaning supplies. In operation, the tray is connected to the bin with fasteners wherein the tray acts as a cover for the storage bin when the bin is attached. Conversely, the bin and tray have a detached position wherein the bin can be emptied without an individual necessarily touching the items within the bin.

The tray also has a partition separating the tray into multiple tray sections, which can be used to hold various cleaning materials. Preferably, the chute is integrally formed within the partition and has a top opening proximate to the top edge of the partition. The chute shares common sidewalls with the partition and both the partition and the chute are enclosed by the sidewalls of the tray. The chute also has a bottom opening opposite from the top opening, which operatively communicates with the bin when the bin is attached. Accordingly, an individual can deposit contaminated materials in the top opening that will travel through the body of the chute and out the bottom opening in the chute and into the bin. Subsequently, the bin can be detached and the contaminated materials can be removed.

Figure 2A:
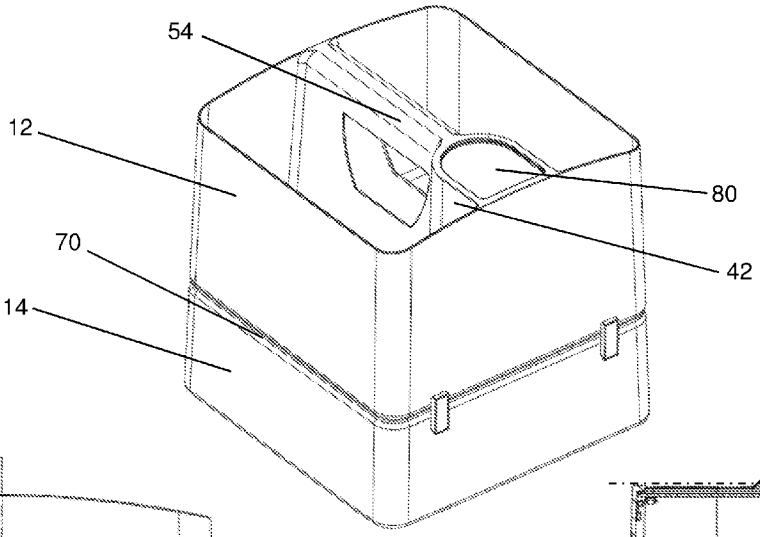
FIGS. 2A and 2B are a perspective view and a side view, respectively, of the caddy for cleaning supplies in an alternative embodiment.
Figure 2B:
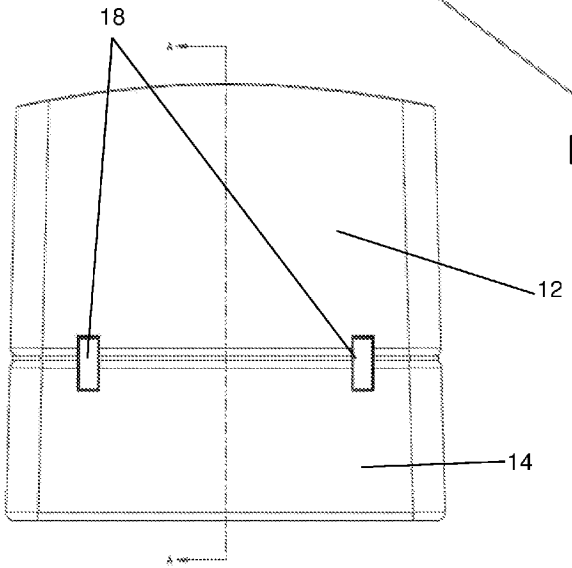
Figure 2C:
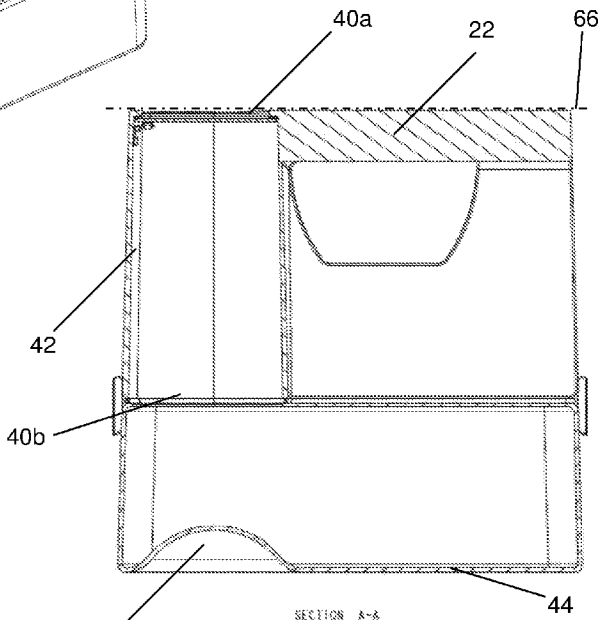
FIG. 2C is cross-sectional side view of the caddy for cleaning supplies in an alternative embodiment.

In another aspect of the invention, a handle is attached to the tray and is preferably integrated with the partition. As shown in the figures and explained in detail below, the handle in the preferred embodiment has a gripping section that is positioned along a plane above the top edge of the sidewalls of the tray. However, alternative embodiments may include handles that are held within the sidewalls of the tray. Further, other handle variations may also be integrated within the partition as shown in FIG. 2. It will be appreciated by those having an ordinary skill in the art that other handle variations may be used, including handles that are connected to the sidewalls of the tray rather than the partition.

As generally described above, the cleaning supply caddy 10 described includes the upper tray 12 that is removably attached to the lower storage bin 14 with the chute 16 operatively extending between the tray and bin. The upper tray portion is preferably positioned above the bin in the attached positioned and includes a bottom 26 and multiple tray sidewalls 30 extending to the top edge 32 of the tray from the periphery 28 of the bottom of the tray. Accordingly, the tray can hold cleaning tools within the tray sidewalls that are accessed through the open topside 74 of the tray, as shown in the figures.

As with currently known cleaning caddies, cleaning tools and supplies may be held in the tray. For example, the tray portion can be used to hold towels, rags, wipes, brushes, cleaning chemicals, spray bottles, gloves and any other similar cleaning supply that may be necessary during a cleaning operation. Accordingly, where there are various items to be held within the tray the invention described herein preferably has multiple sections for holding clean items in addition to the bin for depositing items once they become dirty and contaminated.

The partition 20 extends between the sidewalls of the tray and separates the tray into multiple tray sections and although only a single partition is shown, it will be understood that multiple partitions can be included in the invention described herein. In the preferred embodiment, a single partition longitudinally extends between the sidewalls of the tray and separates the tray into two sections 20*a* and 20*b*. As shown in FIGS. 1 and 2, the partition preferably integrated with the chute which has a first face 34*a* and an opposite face 34*b* where the pair of faces are spaced a distance 36 from one another. The distance between the faces may vary along the cross-section of the partition to provide a larger chute. The partition itself is preferably formed with the tray itself and the bottom edge 38*b* of the partition is attached to the bottom of the tray and the top edge 38*a* of the partition is open to the topside of the tray. As described below, the chute is preferably integrated within the partition with the pair of faces forming at least two of the sidewalls of the chute but other embodiments may use trays without partitions all together and merely have a chute and handle connected to the tray as explained below.

In another aspect of the tray a handle 22 is positioned proximate to the midline of the tray allowing the tray to easily be carried by an individual during cleaning operations. As shown in the figures, the preferred handle is integrated with the partition where a gripping section 54 is between one end 56*a* attached to a first section of the partition 20*a* and the other end 56*b* is attached to another section of the partition 20*b*. As shown, the handle itself is integrated along the top edge of the partition which is aligned with the top edge of the tray sidewalls, as shown in FIG. 2, and the handle has a width 58 that is preferably less than half the distance between faces of the partition. Accordingly, the chute also has a width that is at least twice the width of the handle in order to allow materials to be easily passed there through. As mentioned above, the distance may vary across the length of the partition wherein the distance is wider along the body of the chute than along the top edge of the partition proximate to the sidewalls.

As shown in FIG. 1, the chute is preferably centered beneath the gripping portion of the handle between the partition sections. As shown, the preferred handle not only includes a gripping section but also has a pair of supports 60*a* and 60*b* that are attached to the partition section where the supports extend a handle height 78 to the pair of handle ends. In operation, the partition sections are on opposite sides of the chute and the distal ends 64 of the supports are attached to the top edge of the opposite sections. Additionally, the supports extend the handle height to the gripping section and the proximal ends 62 of the supports are attached to the ends of the gripping section. Accordingly, the gripping section is along a plane 66*a* that is above the top edge of the sidewalls of the tray allowing the handle to be easily by grasped an individual while still permitting the chute to be easily accessed, as shown in FIGS. 1D and 3C. Alternatively, as shown in FIG. 2, the gripping section may be along a plane 66*b* aligned with the top edge of the tray sidewalls.

In an alternative embodiment, the chute may be integrated with the tray at a position offset from the handle, such as shown in FIG. 2, and may even be used on trays without the partition. Accordingly, the chute is not necessarily formed beneath the handle or integrated with the partition and it will be appreciated that the primary function of the chute is to allow the passing of contaminated items into the bin through the top of the tray and thus its position on the tray in relation to the handle or integration with the partition is not intended to be a limiting factor.

Caddy embodiments that do not have a partition in the tray preferably center the chute on the tray to promote proper distribution of materials into bin. Such an embodiment will also likely have the chute centered beneath the handle where it is advantageous to position the handle along the centerline of the caddy for proper weight distribution during carrying. Additionally, the chute being centered on the tray inherently separates the tray into various quadrants and acts as a partial partition.

Alternative embodiments that do not have a partition centered on the tray may incorporate the chute into one of the corners of the tray, or otherwise offset from center, where the sidewalls of the tray form a portion of the chute body. In embodiments without a partition the handle may connect to the sidewalls of the tray or directly to the bottom of the tray and may be removed from the shoot. Although these embodiments may function to provide a single caddy for carrying cleaning supplies and contaminated materials, trays having a partition are preferred where they provide additional support to the tray. Similarly, the partition provides a fixed connection point for the handle without interfering with the sidewalls or bottom of the tray. Accordingly, for the reasons described herein a tray having a chute integrated within the partition and centered below the handle is preferred.

In operation, the partition primarily functions to split the tray into multiple tray sections where one tray section 12*a* is on first face side of the partition and the other tray section 12*b* is on the second face side of the partition. Accordingly, multiple cleaning supplies can be held in each section and separated according to use or based on various types of tray organization. For example, one tray section may be used to hold items used for cleaning a shower while the other tray section is used to hold items for cleaning a bathtub. Accordingly, the tray provides multiple variations to aid individuals in cleaning projects and to prevent cross contamination even when cleaning supplies are not yet contaminated and are still being held in the tray. Additionally, it will be appreciated by those having an ordinary skill in the art that such organization can aid in efficiency along with providing various other benefits associated with multiple tray section. However, it will be further appreciated that all of the various sections, partition and chute are enclosed by the sidewalls of the tray.

Figure 1A:
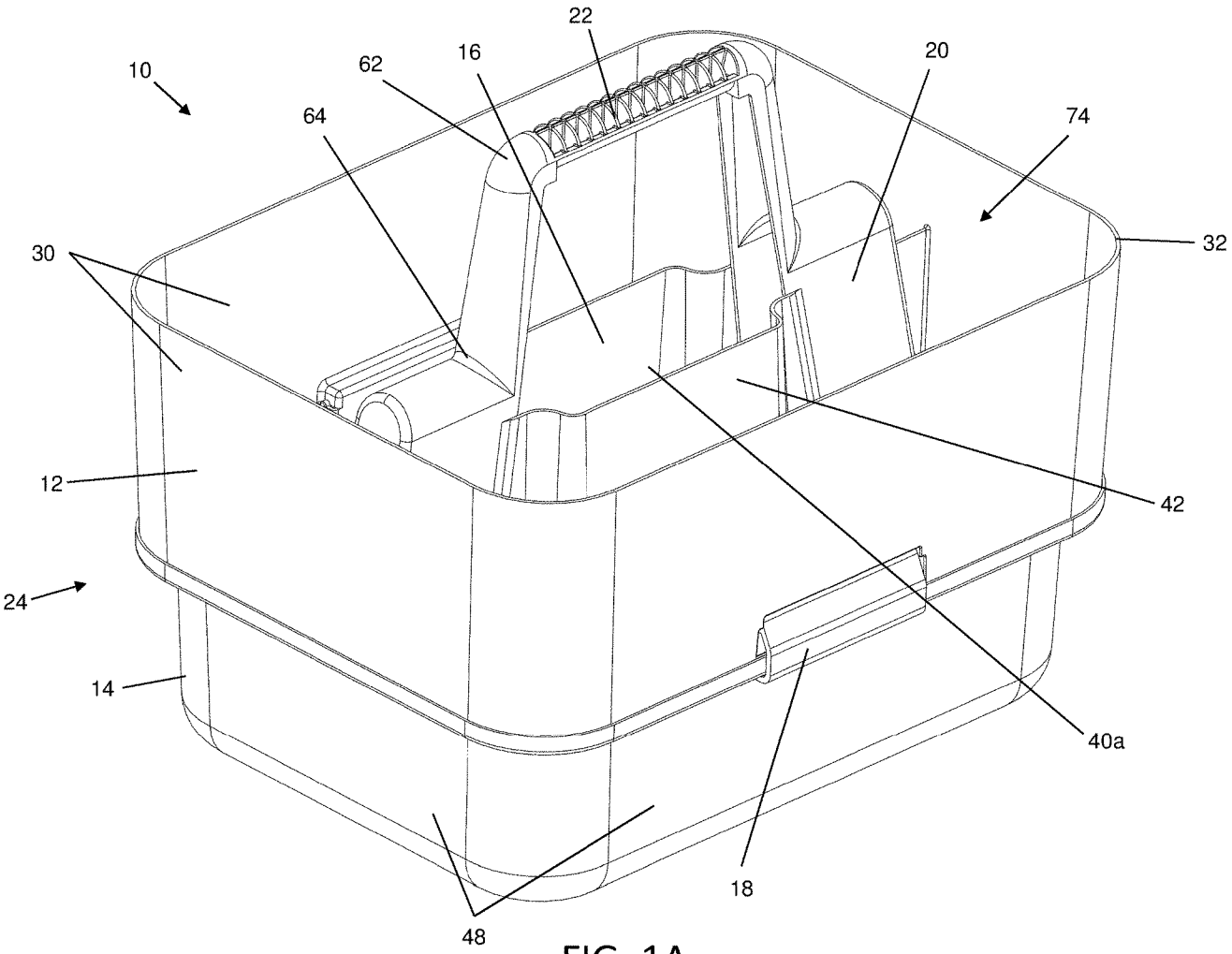
FIG. 1A is a perspective view of the caddy for cleaning supplies in the preferred embodiment.
Figure 1B:
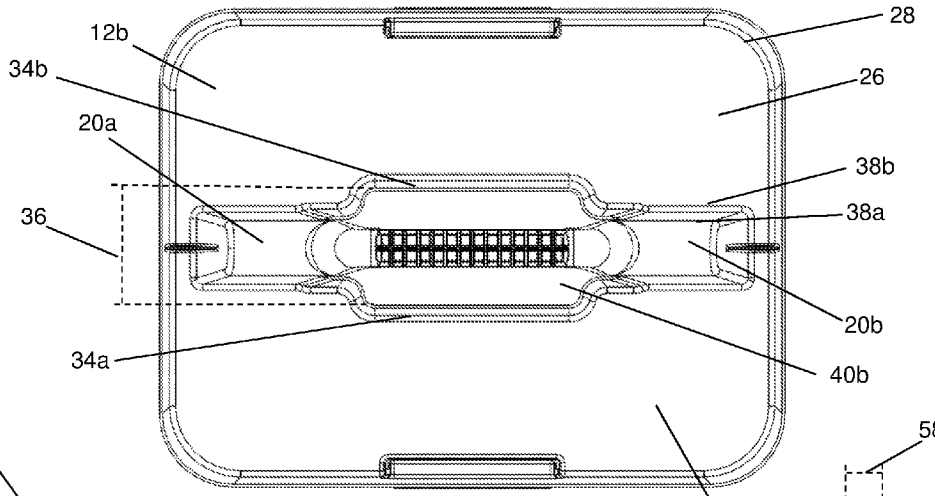
FIGS. 1B and 1C are a top view and side view, respectively, of the caddy for cleaning supplies in the preferred embodiment.
Figure 1C:
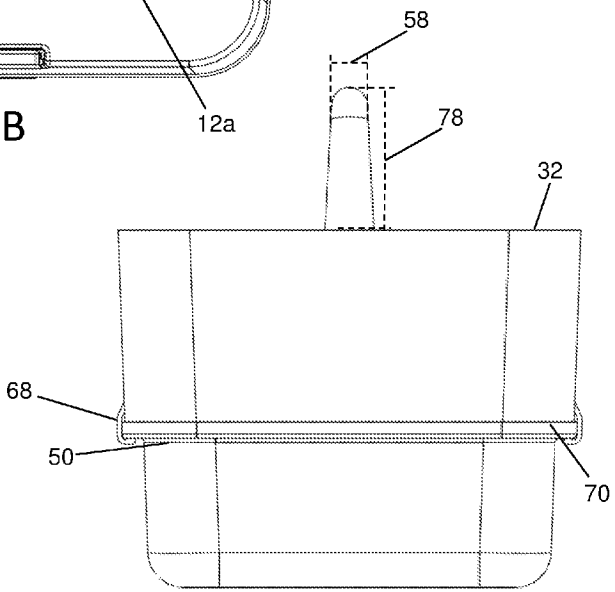
Figure 1D:
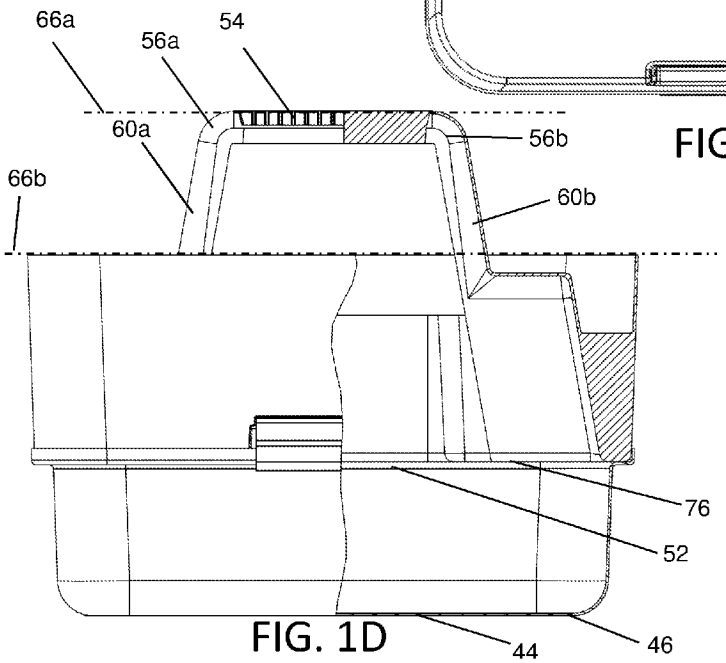
FIG. 1D is a partial cross-sectional side view of the caddy for cleaning supplies in the preferred embodiment.

The chute has a body 42, a top opening proximate 40*a* with the top edge of the chute and a bottom opening 40*b* proximate to the bottom of the tray. Additionally, the chute has multiple sidewalls that define the body of the chute and preferably the first face and the second face form two of the sidewalls of the chute, as shown in FIGS. 1A and 2A. Accordingly, the bottom of the tray has an aperture that forms the bottom opening of the chute allowing materials to be deposited into the top opening the chute, pass through the body of the chute defined by the sidewalls, and exit through the bottom opening. In operation, the bin is attached beneath the tray and materials that are deposited into the top opening therefore pass into the bin. Accordingly, the caddy includes a bin section that holds contaminated materials that are deposited through the chute.

Similar to the tray, the bin includes a bottom 44 and multiple sidewalls 48 that extend from the periphery of the bottom 46 to the top edge of the sidewalls 50 that surround an open topside 52. The bin is removably attached to the underside of the tray 76 in an attached position 24 and the interior of the bin and its contents are not accessible. Conversely, the bin can be detached to reveal the top opening and the materials held within the bin. As mentioned above, the top opening of the bin is open and in communication with the bottom opening of the chute so that material can pass through the chute form the topside of the tray and into the bin without necessarily detaching the bin from the tray.

In the attached position the bin is entirely covered by the tray and the top edges of the sidewalls of the bin are sealed against the underside of the tray. Conversely and as mentioned above the bin top edges can be removed from the underside of the tray in the detached position to open the topside of the bin and allow access to the interior of the bin and its contents. Accordingly, when cleaning is completed and the caddy is moved out of the clean area and the contaminated materials need to be disposed of or cleaned, the bin can be quickly detached and the contents can be accessed. Additionally, to ensure that the bin does not inadvertently become detached and prematurely expose the contaminated items, one or more fasteners 18 are used to sealingly attach the tray to the bin.

The preferred fastener used to sealing connect the bin to the tray is a latch and catch fastener where one of the latch and the catch is connected to the tray and the other of the latch and the catch is connected to the bin. Although not intended to be limiting, the preferred latch and catch 68 fastener is depicted in FIG. 1 where a pivoting latch pivots from an unlocked position to a locked position wherein a portion of the latch engages a catch within a sidewall of the caddy. Similarly, other latch and catch fasteners could be used including a sliding fastener wherein a catch groove is attached to one of the top edge of the bin and the bottom side of the tray and a latch tongue is attached to opposite from the groove. Accordingly, the bin could be slid along the tongue and groove slide, similar to a drawer, rather than unfastened with the preferred latch described above. Although such a slide is acceptable, it is not preferred where the contents within the bin may prevent easy sliding should the bin be filled to the top or materials remain partially within the chute. Additionally, although a latch and catch type fastener is preferred, persons having an ordinary skill in the art will appreciate that other types of fasteners can be used, including but not limited to hook and loop fasteners, snaps, buckles, and pressure sensitive adhesive glues.

Other aspects of the caddy may include a gasket 70 between the bin and tray seal as shown in FIG. 2, for embodiments where spillage is a primary concern, such as when contaminated materials are soiled and cause leaking if the bin and tray are not adequately sealed in the attached position. In such an embodiment a rubber gasket is connected to at least one of the top edge of the bin sidewalls and the bottom of the tray and creates a watertight seal between the bin and the tray to prevent fumes, chemicals, debris, bacteria and other contaminates from escaping.

As shown in FIG. 2, gaskets attached to the tray are preferably mounted to the periphery of the bottom side which seals against the to edge of the bin as the preferred caddy has bin and tray sidewalls that are substantially aligned where the top edge of the bin seals against the periphery of the tray bottom in the attached position. In such an arrangement the bottom of the bin and the bottom of the tray have approximately the same dimensions and the caddy has a uniform profile and size, such as shown in FIGS. 1 and 2.

Additionally, the bottom of the bin may also be outfitted with an indent 72 that extends into the interior of the bin towards the top opening. The indent is positioned below the bottom opening of the chute and functions to disperse contaminated materials within the bin as they are deposited through the chute. Accordingly, contaminated items do not pile below the bottom opening and unintentionally plug the chute before the bin is filled.

The top opening of the chute may also include a lid 80 that closes the top opening when the chute is not being used. Such a lid further separates the contaminated items within the bin from the clean items held in the tray where seal chemicals, fumes chemicals, dirt, debris and similarly contaminates are not prevented from escaping. In operation, the lid includes a torsion spring connected between the underside of the lid and the sidewall of the chute where the torsion spring biases the lid closed. Accordingly, when an individual wants to deposit a material into the shoot they need only push down on the lid to open the chute that will automatically reseal when pressure is removed from the top of the lid.

The lid itself has a female fastening end on the bottom to provide friction fit for one end of the torsion spring where the other end of the torsion spring slips into a similar female fastening end within the body of the chute. The lid is attached to the top opening by a hinge and retaining pin and pivots between the open and closed position. To prevent the spring from biasing the lid past the closed position, the top opening further includes a flange on which the lid seats when closed. As with the seal between the bin and the tray described above, a similar gasket may be incorporated into the chute lid.

However, it will be appreciated by those having an ordinary skill in the art that the lid may also be left off certain embodiments, particularly when the caddy is used in combination with cleaning operations that require chemicals that may not be readily contained. In such an instance proper ventilation may be necessary and the lid should not be used.

Although it will be appreciated that the caddy can be made with various methods and materials, it is preferred that the tray, partition, chute and handle be made as a single unitary piece through a typical plastic contraction method including blow molding, vacuum forming, injection molding, rotational molding and extrusion. Similarly, the bin and lid are also made byway of a traditional plastic forming method. Once the plastic body parts are made, an adequate fastener the gaskets for sealing the lid, bin and tray during the closed and attached positions are attached to the caddy as described above. Alternatively, it will be appreciated that the tongue and groove slide fastener, as well as certain other fasteners, may be integrated with the bin and tray rather than retroactively attached.

The embodiments were chosen and described to best explain the principles of the invention and its practical application to persons who are skilled in the art. As various modifications could be made to the caddy for cleaning supplies described herein, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present disclosure should not be limited by any of the above-described caddy for cleaning supplies, but should be defined only in accordance with the following claims appended hereto and their equivalents.

What is claimed is:

1. A cleaning supply caddy, comprising:

a tray comprising a tray bottom with a bottom periphery, a plurality of tray sidewalls extending from the bottom periphery to a sidewall top edge, a chute, and a handle having a width, wherein the chute comprises a first side face, a second side face spaced a first distance from the first side face, a top opening, a bottom opening, and a body extending between the top opening and the bottom opening, wherein the bottom opening extends through the tray bottom, wherein the first distance is at least twice the width of the handle, and wherein the handle is spaced a second distance from the top opening;

a bin situated below the tray bottom in an attached position, wherein the bin is removably attached to the tray, wherein the bin comprises a bin bottom, a bin top opening, a bin bottom periphery, and a plurality of bin sidewalls extending from the bin bottom periphery to a bin sidewall top edge, wherein the bin is entirely covered by the tray in the attached position, wherein the bin sidewall top edge seals against the tray bottom in the attached position, wherein the bin top opening is open to and in communication with the bottom opening of the chute in the attached position, wherein the bin sidewall top edge is removed from the tray bottom in a detached position, and wherein the bin top opening is uncovered when the tray is in the detached position; and a fastener removably connecting the bin to the tray in the attached position and releasing the bin from the tray in the detached position.

2. The caddy of claim 1, wherein the tray further comprises a partition, wherein the partition extends from the chute to at least one of the plurality of tray sidewalls, and wherein the handle further comprises a gripping section between a first end and a second end.

3. The caddy of claim 2, wherein the top opening of the chute is at least one of aligned with the handle and offset from the handle.

4. The caddy of claim 2, wherein the handle further comprises a pair of supports and a handle height, wherein the pair of supports comprise a proximal end and a distal end, wherein the proximal end of the pair of supports are connected to the first end and the second end of the handle, respectively, wherein the distal end of the pair of supports are connected to the partition, and wherein the pair of supports extend the handle height over the opening of chute with the handle height being greater than the first distance.

5. The caddy of claim 4, wherein the partition further comprises a first partition section, a second partition section extending from opposite sides of the chute, wherein the distal end of one of the pair of supports is connected to the first partition section, wherein the distal end of the other of the pair of supports is connected to the second partition section, and wherein the chute is centered beneath the gripping section of the handle.

6. The caddy of claim 2 further comprising a plurality of tray sections separated by a partition, wherein a first of the plurality of tray sections is proximate to the first face, wherein a second of the plurality of tray sections is proximate to the second face, and wherein the plurality of tray sections, the partition, and the chute are entirely surrounded by the plurality of tray sidewalls.

7. The caddy of claim 1, wherein the fastener comprises a latch and a catch, wherein one of the latch and the catch is connected to the tray, and wherein the other of the latch and the catch is connected to the bin.

8. The caddy of claim 1 further comprising a gasket connected to at least one of the bin sidewall top edge and the bottom periphery, and wherein the gasket sealingly connects the bin to the tray in the attached position.

9. The caddy of claim 1, wherein the sidewall top edge seals against the periphery of the tray bottom in the attached position, and wherein the plurality of bin sidewalls are substantially aligned with the plurality of tray sidewalls.

10. The caddy of claim 1, wherein the bin bottom further comprises an indent, wherein the indent protrudes from the bin bottom towards the bin top opening, and wherein the indent is centered beneath the chute in the attached position.

11. A cleaning supply caddy, comprising:

a tray comprising a tray bottom with a bottom periphery, a plurality of tray sidewalls extending from the bottom periphery to a sidewall top edge, a chute, a partition, and a handle having a width, wherein the chute comprises a first side face, a second side face spaced a distance from the first side face, a top opening, a bottom opening, and a body extending between the top opening and the bottom opening, wherein the bottom opening extends through the tray bottom, wherein the partition comprises a partition top edge, and a partition bottom edge, wherein the partition bottom edge is connected to the tray bottom, wherein the top opening is positioned proximate to the partition top edge, wherein the first distance is at least twice the width of the handle, and wherein the handle is spaced a second distance from the top opening;

a bin situated below the tray bottom in an attached position, wherein the bin is removably attached to the tray, wherein the bin comprises a bin bottom, a bin bottom periphery, and a plurality of bin sidewalls extending from the bin bottom periphery to a bin sidewall top edge, wherein the bin is entirely covered by the tray in the attached position, wherein the bin sidewall top edge seals against the tray bottom in the attached position, and wherein the bin sidewall top edge is removed from the tray bottom in a detached position; and a fastener removably connecting the bin to the tray in the attached position and releasing the bin from the tray in the detached position.

12. The caddy of claim 11, wherein the bin further comprises a bin top opening, wherein the bin top opening is open to and in communication with the bottom opening of the chute in the attached position, and wherein the bin top opening is uncovered when the tray is in the detached position.

13. The caddy of claim 11 further comprising a plurality of tray sections separated by the partition, wherein a first of the plurality of tray sections is proximate to the first face, wherein a second of the plurality of tray sections is proximate to the second face, and wherein the plurality of tray sections, the partition, and the chute are entirely surrounded by the plurality of tray sidewalls.

14. The caddy of claim 11, wherein the partition extends from the chute to at least one of the plurality of sidewalls of the tray, and wherein the chute is at least one of aligned with the handle and offset from the handle.

15. The caddy of claim 11, wherein the handle further comprises a gripping section between a first end and a second end, a pair of supports and a handle height, wherein the partition further comprises a first partition section, a second partition section and the chute, wherein the pair of supports comprise a proximal end and a distal end, wherein the proximal end of the pair of supports are connected to the first end and the second end of the handle, respectively, wherein the distal end of the pair of supports are connected to the first partition section and second partition section at the partition top edge, respectively, and wherein the pair of supports extend the handle height over the opening of chute with the handle height being greater than the first distance, and wherein the chute is centered beneath the gripping section.

16. The caddy of 15, wherein the handle further comprises a handle height, wherein the handle height is at least twice the handle width, and wherein the gripping section of the handle is positioned along a plane above the sidewall of the top edge.

17. A cleaning supply caddy, comprising:

a tray comprising a tray bottom with a bottom periphery, a plurality of tray sidewalls extending from the bottom periphery to a sidewall top edge, a chute, a partition, and a handle having a width, wherein the chute comprises a first side face, a second side face spaced a distance from the first side face, a top opening, a bottom opening, and a body extending between the top opening and the bottom opening, wherein the bottom opening extends through the tray bottom, wherein the partition comprises a partition top edge and a partition bottom edge, wherein the partition bottom edge is connected to the tray bottom, wherein the top opening is positioned proximate to the partition top edge, wherein the first distance is at least twice the width of the handle, wherein the handle comprises a gripping section between a first end and a second end, a pair of supports, and a handle height, wherein the pair of supports comprise a proximal end and a distal end, wherein the proximal end of the pair of supports are connected to the first end and the second end of the handle, respectively, wherein the distal end of the pair of supports are connected to the partition top edge, respectively, and wherein the pair of supports extend the handle height over the opening of chute with the handle height being greater than the first distance, and wherein the chute is centered beneath the gripping section;

a bin situated below the tray bottom in an attached position, wherein the bin is removably attached to the tray, wherein the bin comprises a bin bottom, a bin top opening, a bin bottom periphery, and a plurality of bin sidewalls extending from the bin bottom periphery to a bin sidewall top edge, wherein the bin is entirely covered by the tray in the attached position, wherein the bin sidewall top edge seals against the tray bottom in the attached position, wherein the bin top opening is open to and in communication with the bottom opening of the chute in the attached position, wherein the bin sidewall top edge is removed from the tray bottom in a detached position, and wherein the bin top opening is uncovered when the tray is in the detached position; and a plurality of fasteners removably connecting the bin to the tray in the attached position and releasing the bin from the tray in the detached position.

18. The caddy of claim 17 further comprising a plurality of tray sections separated by the partition, wherein a first of the plurality of tray sections is proximate to the first face, wherein a second of the plurality of tray sections is proximate to the second face, and wherein the plurality of tray sections, the partition, and the chute are entirely surrounded by the plurality of tray sidewalls.

19. The caddy of claim 17, wherein the partition further comprises a first partition section, a second partition section extending from opposite sides of the chute, wherein the distal end of one of the pair of supports is connected to the first partition section, wherein the distal end of the other of the pair of supports is connected to the second partition section, wherein the chute is centered on the tray bottom beneath the gripping section, and wherein the handle is spaced a second distance from the top opening.

20. The caddy of claim 19, wherein the bin bottom further comprises an indent, wherein the indent protrudes from the bin bottom towards the bin top opening, and wherein the indent is centered beneath the chute in the attached position.

* * * * *